US007127775B2

(12) United States Patent
Ferre et al.

(10) Patent No.: US 7,127,775 B2
(45) Date of Patent: Oct. 31, 2006

(54) HINGE ATTACHMENT AND ASSOCIATED METHOD OF MAKING AND ASSEMBLING A DOOR AND DOOR FRAME

(75) Inventors: Michael Frank Ferre, Peoria, IL (US); Thomas Edward Ferre, Peoria, IL (US); Stephen Paul Cramer, Peoria, IL (US)

(73) Assignee: Sentry Security Fasteners, Inc., Peoria, IL (US)

( * ) Notice: Subject to any disclaimer, the term of this patent is extended or adjusted under 35 U.S.C. 154(b) by 83 days.

(21) Appl. No.: 10/710,591

(22) Filed: Jul. 22, 2004

(65) Prior Publication Data

US 2005/0015931 A1 Jan. 27, 2005

Related U.S. Application Data

(60) Provisional application No. 60/481,125, filed on Jul. 23, 2003.

(51) Int. Cl.
*E05D 11/00* (2006.01)
*E05D 5/02* (2006.01)

(52) U.S. Cl. ..... 16/223; 16/382; 16/388

(58) Field of Classification Search ..... 16/223, 16/382, 366, 368, 235, 236–238, 242, 243, 16/248, 387, 388; 49/398–400
See application file for complete search history.

(56) References Cited

U.S. PATENT DOCUMENTS 310,033 A * 12/1884 Collamore ..... 16/246
2,791,239 A * 5/1957 Mason ..... 138/45
4,057,873 A * 11/1977 Bursani ..... 16/388
4,131,969 A * 1/1979 Suska ..... 16/388
4,438,597 A * 3/1984 Maggart ..... 49/501
4,547,930 A * 10/1985 King et al. ..... 16/382
4,553,286 A * 11/1985 Schwarz, II ..... 16/382
4,704,767 A * 11/1987 Carter et al. ..... 16/388
4,825,509 A * 5/1989 Mitchell et al. ..... 16/382
5,072,488 A * 12/1991 Winyard ..... 16/241
5,075,928 A * 12/1991 Bobrowski ..... 16/273
5,347,686 A * 9/1994 Tyler et al. ..... 16/247
5,357,725 A * 10/1994 Ferry ..... 52/210
6,286,185 B1 * 9/2001 Ramsauer ..... 16/236
6,430,779 B1 * 8/2002 Goldsmith et al. ..... 16/382

FOREIGN PATENT DOCUMENTS

DE 3722760 A * 1/1988
DE 4432500 A1 * 3/1996
GB 2335720 A * 9/1999
RU 2053344 C1 * 1/1996

* cited by examiner

*Primary Examiner*—Chuck Y. Mah
(74) *Attorney, Agent, or Firm*—Thompson Coburn LLP

(57) ABSTRACT

An improved door hinge attachment device is provided. The device includes a plate formed separately of the door and door frame that is attached to a door or door frame. The device has elongate threaded bores alignable with screw holes in the hinge plates. The device is useful with metal doors and door frames. The attachment devices have projections on the backside thereof and may be provided with covers to prevent construction material or debris from fouling the threads in the threaded bores.

15 Claims, 3 Drawing Sheets

HINGE ATTACHMENT AND ASSOCIATED METHOD OF MAKING AND ASSEMBLING A DOOR AND DOOR FRAME

CROSS REFERENCE TO RELATED APPLICATIONS

This patent application claims priority to U.S. Provisional Patent Application Ser. No. 60/481,125 filed Jul. 23, 2003, the disclosure of which is incorporated herein by reference.

BACKGROUND OF INVENTION

Metal doors and metal door frames are well known in the art. A door is connected to the door frame by one or more hinges in a vertically spaced orientation. One common way to prepare a door or door frame for the installation of a hinge is to first form a metal attachment plate with a hinge plate recess. A recess in the plate has desired offset or depth to accommodate at least a portion of the thickness of the hinge plate. Screw holes are tapped in the attachment plate to form screw threads to accept screw fasteners. The attachment plate is then secured at a respective location to the door or door frame for receipt of a hinge plate in the recess and securement of a hinge to the door or door frame. Typically the attachment plates are thin and also are made of low strength steel such as cold rolled steel. Such an arrangement has offered a low pullout strength and often results in a thread failure or stripping of the tapped hole and failure of the door to operate properly and in some cases a failure of the door to open or close at all. Screw pullout strength can be a significant problem with heavy doors such as those used in prisons. Another current problem that exists during the installation of a metal door frame occurs when grout is poured into or other construction material is installed in the hollow area between the door frame and the building structure after the hinge attachment device is in place. A portion of the hinge attachment device is often exposed on the inside of the door frame. This permits any construction material, for example grout, put into the hollow space between the door frame and the building, to flow or move into contact with the hinge attachment device and enter the tapped screw holes making the screws hard or even impossible to install without removing the interfering construction material from the tapped holes. This may require retapping of the holes which often times will result in a threaded hole which is not useable because of the construction of the hinge attachment device. Such door and door frame constructions are of the type that are assembled at a work site without the hinge attachment screws already being in place. If the hinge attachment screws are in place during installation of the door frame, construction material may also adhere to and foul the screw threads. This would present a problem when the screws need to be extracted since the construction material would interfere with their extraction possibly causing damage to the screws or the threaded holes for the screws.

The present invention is directed to overcoming one or more of the problems set forth above.

SUMMARY OF INVENTION

The present invention relates to a hinge attachment device for use with metal doors and door frames providing ease of assembly and strong construction.

The present invention is generally directed to a hinged door construction and associated door hinges. The door and door frame are of a metal construction and the door may be of a hollow metal type. The door frame and door have hinge attachment devices secured thereto. Such attachment devices are made from a piece of metal that accommodates the width of the door and hinge attachment areas of the door frame and are preferably welded to the door and door frame. Projection weld spots may be provided on the hinge attachment devices. Threaded projections are provided on the hinge attachment device for securing the hinge plates to the outside of the door frame or outside of the door so that the hinge recesses in the attachment devices are planar accommodating a planar hinge plate. The threaded projections extend from the back of the attachment devices to significantly increase the pullout strength of the screws and hinge from the hinge attachment device. Protective cover or covering may be provided over the ends of the threaded projections when installed on the door frame to prevent foreign material from entering the threaded portion of the projections to prevent foreign material from fouling the threaded bores in the projections. By pre-locating and prethreading the hinge attachment device apertures and the projections, precise placement of the hinges on the door and the frame can be accomplished and thereby ensure correct alignment of the hinge plates when assembled with the door and door frame.

One aspect of the present invention is to provide a hinge attachment device that has threaded projections suitably attached thereto preferably of a high strength steel. The use of the hinge attachment device provides increased durability and ease of manufacturing.

Another aspect of the present invention is to provide projection weld spots on the attachment devices to improve securement of the attachment devices to either the door or door frame by welding. The use of protuberances or raised weld spots will allow for quick and accurate installation of the hinge attachment device and can be used to align the plate to cooperating and corresponding spots on the door or door frame.

Still another aspect of the present invention is to provide witness marks for security studs or electrical wiring on the exposed surface of the attachment devices if desired. This will facilitate drilling of holes for the installation of security studs or electrical wiring. The witness marks may be used for location and appropriate sizing of the holes needed.

Yet another aspect of this present invention is to provide means to protect the threaded projections to protect the screw threads in the projections from the entry of foreign material. The use of covers eliminates the need for costly processes like welding grout guards or hinge pockets to the frame.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings, where like numbers throughout the various Figures designate like or similar parts, in which.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures and components have not been described in detail so as to obscure the present invention. For example, the invention can be applied to virtually any type of door utilizing a hinge.

Figure 1:
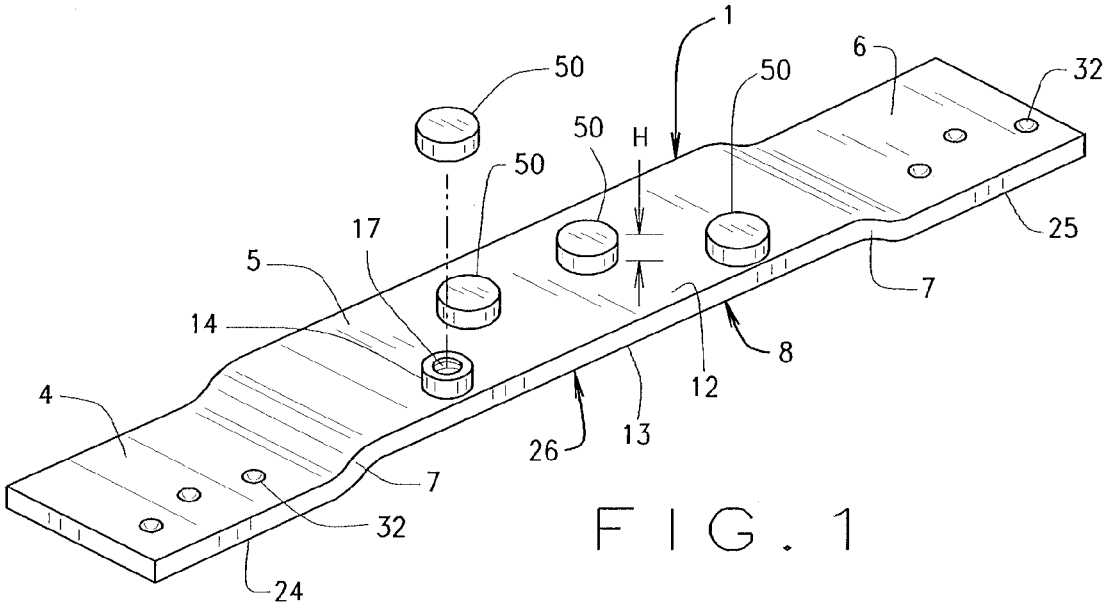
FIG. 1 is a perspective view of a hinge attachment plate showing the surface that will be hidden when the plate is installed on a door or door frame.
Figure 2:
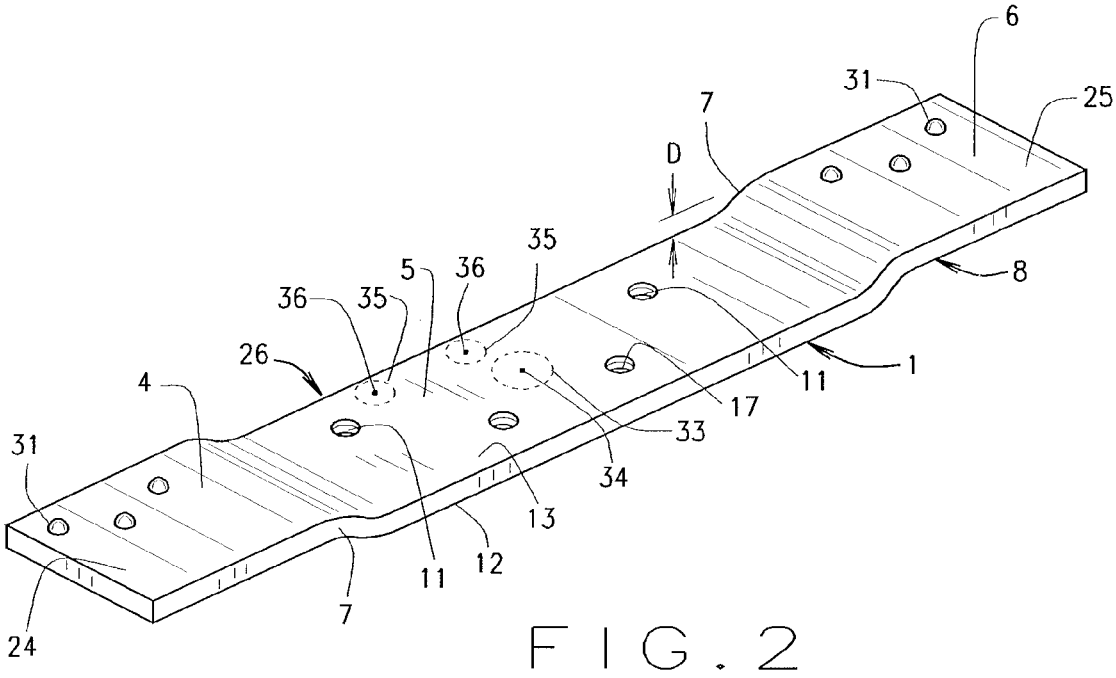
FIG. 2 is a perspective view of the hinge plate of FIG. 1 showing out the face that will be outside when installed on a door or door frame.
Figure 3:
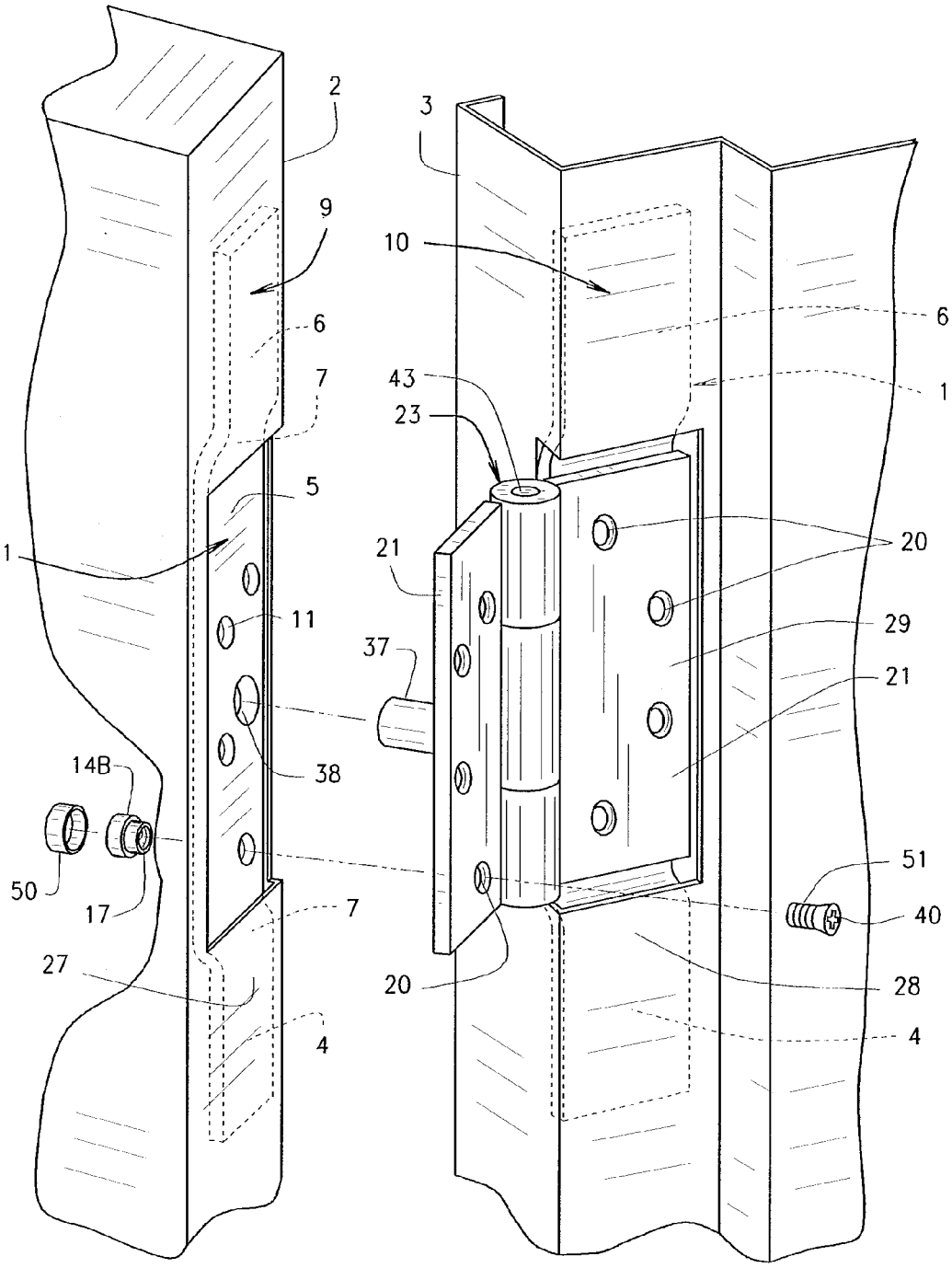
FIG. 3 is an exploded perspective view of a portion of a door and door frame with the door in an open position showing the hinge attachment devices and a hinge attaching the door to the door frame, hidden portions of the attachment devices are shown in phantom.

A hinge attachment device, designated generally as 1, is illustrated in FIGS. 1 and 2. The device 1 can be used for attachment to a door 2 and a door frame 3, as shown in FIG. 3. The device is adapted to be used in both a door 2 and door frame 3 simplifying both production and inventory control. As shown, the device 1 includes a thin metal plate 8, e.g. ⅛–3/16" thick, which has three generally planar portions 4, 5, and 6 with the central portion 5 being positioned between and attached to the end portions 4 and 6. The portions 4, 5, and 6 are generally planar on their exposed or front major surfaces or faces 13, 24, 25. A formed plate 8 also includes bights 7 that may be formed by suitably bending a generally planar sheet of metal cut to the correct dimensions and shape. The bights 7 connect the portion 5 at each end thereof to the respective portion 4 or 6. The bight portions 7 may be inclined or generally perpendicular to the portions 4, 5, and 6. In some instances, the bights 7 may be continuous with portions 4, 5 and 6 making the hinge attachment device 1 effectively flat. Preferably, the attachment device is metal, such as low grade steel, e.g., cold rolled-type steel.

Figure 6:
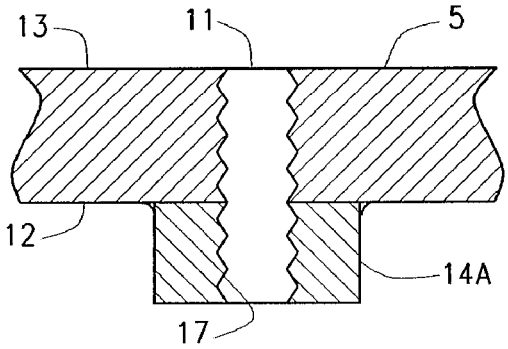
FIG. 6 is an enlarged fragmentary sectional view of an alternative construction of projection and attachment device.
Figure 7:
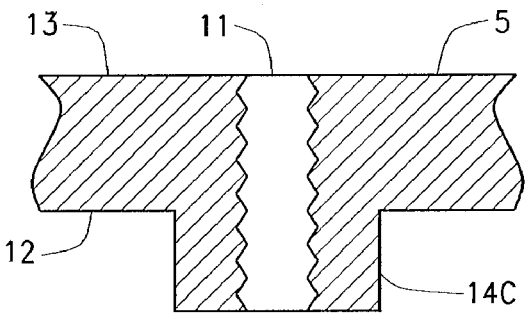
FIG. 7 is an enlarged fragmentary sectional view of an additional alternative construction of projection and attachment device.

The plate 8 is provided with the plurality of suitably spaced and located apertures 11, as shown in FIG. 2, passing therethrough between opposite exposed surfaces 12, 13 of the portion 5. Projection members 14 are suitably secured to the back surface 12 of the portion 5 and project therefrom as seen in FIGS. 1, 2. One form of securement is by welding, FIG. 6, where the projection is denoted as 14A. Alternatively, the projections 14 may be formed as integral parts of the plate 8, as shown in FIG. 7 where the projection is denoted as 14C. The projections may also be secured to the portion 5 as by being press fit, FIGS. 3, 5, into formed holes in the plate 8 to ensure proper location and registration of the apertures 11 and the throughbores. Such press fit projections are denoted 14B. The projections 14 each have an axially extending throughbore 17 that is suitably threaded. The projections 14 may be threaded before or after installation and with the apertures 11 and throughbores 17 suitably aligned, the apertures 11 may be threaded if desired by passing a tap or other threading device through a threaded bore 17 thus ensuring registration of the threads in the portion 5 and the projections 14.

The projections 14 may be of any suitable cross-sectional shape such as hexagonal or cylindrical tubular members. The apertures 11 and throughbores 17 have longitudinal axes that are coaxial and which are generally perpendicular to the opposite surfaces 12, 13 of the portion 5. The apertures 11 in the portion 5 may also have a countersink or the like at the exposed face 13 to ensure a hinge plate 21 of the hinge 23 will lie flat on the exposed face 13 in the event the respective screw holes 20 in the hinge plate may have a burr or the like which would prevent it from lying flat on the central portion 5.

The plate 8 is bent at the bights 7 to create an offset of the exposed face 13 of the portion 5 from the faces 24, 25 of the portions 4, 6 respectively to provide a recess 26 for the hinge plate 21 to be positioned at the appropriate depth when mounted to the door 2 or door frame 3 to allow the edge 27 of the door to fit relatively tight with the face inside 28 of the door frame. The depth D, as shown in FIG. 2, of the recess 26 formed by the bights 7 and portion 5 will be determined by the thickness of the hinge plate 21 and the spacing needed between the edge face 27 of the door 2 and the inside face 28 of the door frame 3. Preferably, the exposed face 29 of a hinge plate will be flush to below flush with the faces 27, 28 and/or the faces 24, 25 depending on construction of the attachment device 1 and the door 2 and/or door frame 3.

Protuberances 31 and corresponding indentations 32 are provided in the portions 4, 6. The protuberances 31 and indentations 32 are suitably located and present in suitable numbers to help effect securement of the device 1 to a respective door frame 3 or door 2. The indentations 32 provide indications of the locations of where a welder should contact the device 1 in order to effect securement of the device 1 to the door 9 or door frame 10. Securement can be accomplished by the use of a spot welder or the like, thus facilitating assembly of the devices 1 to either the door 2 or door frame 3.

Suitable witness marks may be provided to indicate the location for holes that may be drilled before or after attachment of the devices 1 to provide for a security stud or wiring. As best seen in FIG. 2, there is a first set witness marks 33, 34. The mark 33 indicates the outer perimeter of a hole to be drilled and the mark 34 indicates the center of the potential hole. The marks 33, 34 help align and size a suitable drill bit for drilling through the device 1 before or after attachment to a door 2 or door frame 3. The hole 38, as shown in FIG. 3, may be formed at the witness mark 33 and can be used to receive a security stud 37 on the hinge 23. There is shown a second set of witness marks designated 35, 36 as best seen in FIG. 2. The marks 35 indicate the location of the outer perimeter of a hole to be drilled and the marks 36 indicate the center of the witness mark 35 for positioning of a drill bit or the like. The use of the witness marks 35, 36 help appropriately locate and size a hole to be formed for the installation of electrical wiring through the device and into the door 2 or door frame 3. Also, the witness marks 35, 36 can be used to locate, for example, a switch device such as an electrical switch for use with a security system. Recesses may be formed at the marks 34, 36, as by punching, to help center a drill bit for drilling a respective hole. Alternatively, through holes may be preformed at the location(s) of one or more of the witness marks 33, 35.

Screws 40 are used to attach the hinge plates 21 and hence hinge 23 to the hinge attachment device 1 for the door 9 and the hinge attachment device 1 for the door frame 10 as desired. Hinge 23 includes a hinge pin 43 that pivotally connects the hinge plates 21 together. The hinge plates 21 have holes 20 that are sized and located to register with the apertures 11. The projections 14 have a height H, as shown in FIG. 1, to provide a total threaded length in the portion 5 and projection 14 of preferably at least about one screw diameter. As shown, when installed, the hinge 23 mounts to the hinge attachment devices 1 and hence the door 2 and the door frame 3.

One or more hinges 23 are used to mount the door 2 to the door frame 3 preferably after the door frame has been suitably installed in a doorway in a building structure.

As best seen in FIGS. 1 and 3, protective coverings 50 are attached to each of projections 14 to selectively seal the threaded bores 17. The covering 50 may be molded plastic and sized to be retained on the projections by friction or interference fit. The covering 50 may also be vinyl, liquid plastic, self-adhesive covering, or other suitable material. The screws 40, when installed may, if the threaded shanks 51 are longer than the depths of the threaded bores 14 and apertures 11, simply move the covering 50 on the projections including moving a covering 50 off the projections 14.

Figure 4:
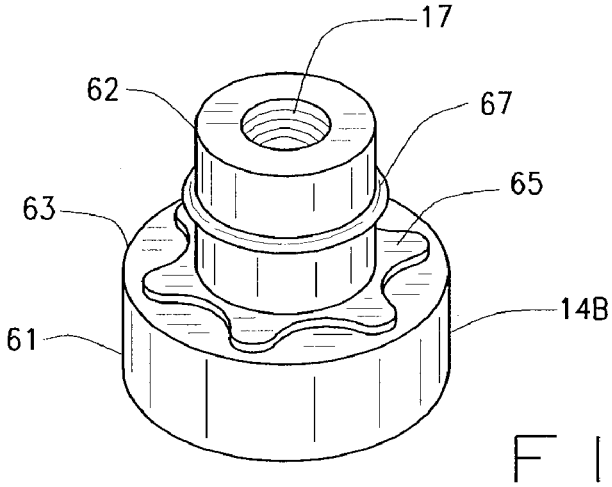
FIG. 4 is an enlarged perspective view of a preferred form of projection.
Figure 5:
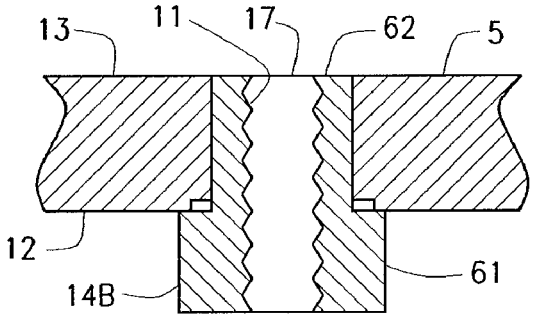
FIG. 5 is an enlarged fragmentary sectional view of the projection of FIG. 4 attached to an attachment device.

The method includes both the method of forming the attachment device 1 and the method of assembling a door to a door frame. The device 1 may be suitably formed from a generally planar sheet, of, e.g., metal, by bending it into the three portions 4, 5, 6 and forming the bights 7 therebetween as necessary. This can be done by stamping, rolling or extrusion. The device 1 may also be formed by extrusion. If extruded, an elongate strip of extrudate will be formed and cut transversely into the appropriate lengths. The projections 14 are suitably secured to the backside 12 of the plate 8 by any suitable method, as by welding, press fitting into apertures 11 on the backside 12, etc. FIGS. 4 and 5 illustrate a projection 14B adapted for press fit attachment to the central portion 5. The projection 14B includes an enlarged head 61 and a coaxial shank 62 with a shoulder 63 therebetween. The shoulder 63 includes an axially projecting interference member 65 adapted to deform the center portion 5 when pressed thereinto to prevent relative rotation between the central portion 5 and projection 14B. An outwardly projecting rib 67 may be provided to enhance the interference fit between the surface defining the aperture 11 and the shank 62. The shank 62 is sized to also provide an interference fit of the shank with the center portion 5. A preferred projection is a Strux nut from Textron. Preferably, the projection 14B is made of a high-strength steel such as grade 8 steel which is preferably harder and stronger than the material forming the center portion 5. Alternately, the plate 8 may be formed by die casting, see FIG. 7, or the like in which case the projections denoted 14C may be integrally formed as part of the plate 8. An aperture 11 and respective bore 17 may be formed with their axes being longitudinally aligned or coaxial. The bore 17 and apertures 11 may be threaded before assembly or after assembly as by tapping. Alternately, in the case of a die cast device 1, the threading of the apertures 11 and bores 17 may be accomplished during the die casting process. The protuberances 31 and recesses 32 may be formed by punching or stamping. Alternately, if the plate 8 is die cast they may be formed during the die casting process.

The formed devices 1 may be attached to the door 2 and door frame 3 either at the work site or at the manufacturing plant. Preferably, the plates 8 are welded in place to the door 2 and door frame 3 wherein only the portion 5 is exposed. After attachment to a door 2 or door frame 3, the plates 8 are inside the door except for the exposure of the portions 5.

The hinge 23 is assembled to a respective door 2 or door frame 3 through the use of the screws 40. If desired, holes may be formed at the witness marks 33, 35 and suitable equipment installed, as for example, electrical devices or the security stud 37. The holes at the witness marks 33, 35 may be also pre-formed if desired. If the device 1 and the door frame 3 is to be subjected to possible exposure to a construction material or other material that could foul the threads in the threaded bores 17 or apertures 11, coverings 50 may be installed over the projections 14 prior to the exposure of the problematic material to the device 1 and the door frame 3. The screws 40, if the length is sufficiently long, may simply push the covering 50 axially and longitudinally along the projection 14 until the screw 40 reaches the desired depth. Additionally, the screw 40 may push the covering 50 completely off the projection 14. The covering 50 thus prevents fouling of the threads but does not interfere with the installation of the hinge 23 via the screws 40. If the hinge 23 is separated into the two separate hinge plates 21 prior to attaching the plates 21 to the respective device 1, the door may be lifted into place and the hinge pins 43 installed. Alternatively, the door 2 may be attached to the door frame 3 with the hinge plates 21 being attached to each other via the hinge pin 43.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

The invention claimed is:

1. A hinge attachment device for securement to a door frame or door, said device including:

a plate member having a central portion with generally opposite ends and an end portion connected to and extending from each of the central planar portion opposite ends, said central and end portions each having a generally planar front surface, wherein the central portion front surface being offset from the front surface of the end portions forming a hinge plate receiving recess, each said end portion being connected to the central portion at a respective said central portion end by a respective bight portion;

a plurality of projections secured to the central portion and extending from a back surface of the central portion, said back surface facing generally opposite to the central portion front surface;

bores extending through the projections and the central portion for receipt of screw fasteners therein for mounting a hinge plate to the plate member; and including a cover removably mounted to each of the projections to cover a respective bore end.

2. The hinge attachment device as set forth in claim 1, including a plurality of protuberances projecting from the front surface of each end portion and each protuberance having a corresponding indentation recessed in a back surface of each of the end portions, said back surfaces of the end portions facing generally opposite to the respective end portion front surface.

3. The hinge attachment device as set forth in claim 2, including at least one witness mark of the front surface of the central portion.

4. The hinge attachment device as set forth in claim 2, wherein the bores are threaded.

5. The hinge attachment device as set forth in claim 1, wherein the bores are threaded.

6. The hinge attachment device of claim 1, in combination with a door frame, wherein a first hinge attachment device being secured to the door frame with said recess being exposed.

7. The hinge attachment device of claim 6, in combination with a second hinge attachment device in combination with a door, wherein the second hinge attachment device being secured to the door with the respective said recess being exposed.

8. The hinge attachment device of claim 1, in combination with a door, wherein a first hinge attachment device being secured to the door with the respective said recess being exposed.

9. A method of mounting a door to a door frame, said method including:

attaching a first hinge attachment device to a door frame, said first attachment device having a central portion and opposite end portions, said central portion having generally opposite first and second surfaces with the first surface being exposed and the second surface having a plurality of first projections extending therefrom, said first projections each having a bore extending toward the first surface;

attaching a second hinge attachment device to a door, said second attachment device having a central portion and opposite end portions, said central portion having generally opposite third and fourth surfaces with the third surface being exposed and the fourth surface having a plurality of second projections extending therefrom, said second projections each having a bore extending toward the third surface;

attaching a cover removably mounted to each of the projections to cover a respective bore end; and attaching a hinge plate to each of the first and second attachment devices with screw fasteners each extending into a respective said bore.

10. The method of mounting a door to a door frame as set forth in claim 9, wherein the central portion of the first and second attachment devices are offset from the respective end portions forming a respective hinge plate receiving recess in each of the first and second attachment devices.

11. The method as set forth in claim 10, wherein the first and second attachment devices being secured to the door frame and the door, respectively, by welding.

12. The method as set forth in claim 9, wherein the bores of the first projections and the bores of the second projections are located and threaded prior to the step of attaching the first hinge attachment device to the door frame and attaching the second hinge attachment device to the door.

13. A security door hinge assembly consisting of:

A first hinge attachment device, a second hinge attachment device, a hinge, a door, and a door frame;

wherein each of the first and second hinge attachment devices include a plate member having a central planar portion with generally opposite ends and an end portion connected to and extending from each of the central planar portion opposite ends, said central planar portion and end portions each having a generally planar front surface;

a plurality of projections secured to each said central planar portion and extending from a back surface of each said central planar portion, said back surface facing generally opposite to said central planar portion front surface;

including a cover removably mounted to each of the projections to cover a respective bore end; and bores extending through the projections and said central planar portion for receipt of screw fasteners therein for mounting a hinge plate to the plate member.

14. The security door hinge assembly of claim 13, wherein the first hinge attachment device being secured to the door such that the central portion of the generally planar front surface of the first hinge attachment device being exposed; and the second hinge attachment device being secured to the door frame such that the central portion of the generally planar front surface of the second hinge attachment device being exposed.

15. The security door hinge assembly of claim 13, wherein the first hinge attachment device includes an aperture therethrough to permit passage of a security stud; and wherein the hinge includes a security stud mounted thereto such that the security stud passes through the aperture of the hinge and the aperture of the hinge attachment device when the door is in the closed position.

* * * * *